US012214404B2

(12) United States Patent
Angerer et al.

(10) Patent No.: US 12,214,404 B2
(45) Date of Patent: Feb. 4, 2025

(54) PRESS BRAKE FOR BENDING WORKPIECES

(71) Applicant: TRUMPF Maschinen Austria GmbH & Co. KG., Pasching (AT)

(72) Inventors: Gerhard Angerer, Altenberg (AT); Klemens Freudenthaler, Linz (AT); Florian Hausmann, Traun (AT); Nenad Kovjenic, Linz (AT); Florian Maier, Leonding (AT); Michael Schernhammer, Leonding (AT); Verena Steininger, Linz (AT); Helmut Theis, Pfarrkirchen (AT)

(73) Assignee: TRUMPF Maschinen Austria GmbH & Co. KG, Pasching (AT)

( * ) Notice: Subject to any disclaimer, the term of this patent is extended or adjusted under 35 U.S.C. 154(b) by 242 days.

(21) Appl. No.: 17/783,428

(22) PCT Filed: Dec. 16, 2020

(86) PCT No.: PCT/AT2020/060474

§ 371 (c)(1),
(2) Date: Jun. 8, 2022

(87) PCT Pub. No.: WO2021/119707

PCT Pub. Date: Jun. 24, 2021

(65) Prior Publication Data

US 2023/0026862 A1 Jan. 26, 2023

(30) Foreign Application Priority Data

Dec. 20, 2019 (AT) ..... A 51144/2019

(51) Int. Cl.
*B21D 5/02* (2006.01)
*B21D 5/00* (2006.01)

(52) U.S. Cl.
CPC ..... *B21D 5/02* (2013.01); *B21D 5/004* (2013.01)

(58) Field of Classification Search
CPC . B21D 5/004; B21D 5/02; B21D 5/04; G05B 2219/45143
See application file for complete search history.

(56) References Cited

U.S. PATENT DOCUMENTS

2014/0132720 A1* 5/2014 Rogers ..... B21D 5/004 345/173
2015/0068412 A1* 3/2015 Yanagi ..... B21D 5/004 100/35

(Continued)

FOREIGN PATENT DOCUMENTS

AT 519 203 B1 4/2018
CN 102063218 A * 5/2011

(Continued)

OTHER PUBLICATIONS

International Search Report in PCT/AT2020/060474, mailed Mar. 22, 2021.

*Primary Examiner* — Jared O Brown
(74) *Attorney, Agent, or Firm* — Collard & Roe, P.C.

(57) ABSTRACT

A press brake for bending workpieces includes: a fixed table beam with a lower tool holder, a displaceable press beam with an upper tool holder, wherein the press beam is formed so as to be displaceable relative to the table beam, and a graphic display for displaying information. In the displaceable press beam, a recess is formed, in which the graphic display is accommodated, wherein the graphic display has a display height and a display width.

16 Claims, 5 Drawing Sheets

(56) References Cited

U.S. PATENT DOCUMENTS

| | | | |
|---|---|---|---|
| 2019/0210083 | A1 | 7/2019 | Angerer et al. |
| 2019/0217358 | A1 | 7/2019 | Angerer et al. |

FOREIGN PATENT DOCUMENTS

| | | | | | |
|---|---|---|---|---|---|
| CN | 105227715 | A | * | 1/2016 | |
| DE | 2020 1400 8019 | U1 | | 1/2016 | |
| EP | 3309967 | A1 | * | 4/2018 | ..... H03K 17/975 |
| JP | 2000015340 | A | | 1/2000 | |
| WO | 2018/039696 | A1 | | 3/2018 | |

* cited by examiner

PRESS BRAKE FOR BENDING WORKPIECES

CROSS REFERENCE TO RELATED APPLICATIONS

This application is the National Stage of PCT/AT2020/060474 filed on Dec. 16, 2020, which claims priority under 35 U.S.C. § 119 of Austrian Application No. A 51144/2019 filed on Dec. 20, 2019, the disclosure of which is incorporated by reference. The international application under PCT article 21(2) was not published in English.

BACKGROUND OF THE INVENTION

1. Field of the Invention

The invention relates to a press brake for bending workpieces.

2. Description of the Related Art

AT 519 203 B1 discloses a generic press brake with a control device, which may comprise multiple components, for example multiple processors and/or computer components, input means for inputting control commands, output means for displaying information, etc. The output means for displaying information are arranged on the machine frame of the press brake in this case.

SUMMARY OF THE INVENTION

The object of the present invention was to provide a press brake, which has increased ergonomics and thus increased machine safety.

This object is achieved by a press brake according to the claims.

According to the invention, a press brake for bending workpieces is formed. The press brake comprises a fixed table beam with a lower tool holder and a displaceable press beam with an upper tool holder, wherein the press beam is formed to be displaceable relative to the table beam. In the displaceable press beam, a recess is formed, in which a graphic display is accommodated, wherein the graphic display has a display height and a display width.

The press brake according to the invention has the advantage that the graphic display is accommodated directly in the displaceable press beam. This leads to a surprising increase in user ergonomics and thus to an increase in machine safety.

Furthermore, it may be useful if a cover plate with a cover plate height and a cover plate width is formed, which is arranged in front of the graphic display so as to cover it, in particular that the cover plate is accommodated in the recess such that a front side of the cover plate forms an indentation relative to the surface of the press beam. This entails the advantage that by this measure, the graphic display can be protected from external influences, whereby the longevity of the press brake can be increased.

Furthermore, it may be provided that a touch sensor, in particular a capacitive sensor, is arranged on a rear side of the cover plate, wherein the touch sensor is mounted directly on the cover plate by means of a materially bonded connection, in particular an adhesive connection.

This measure may help achieve that the press beam cannot only be used for displaying information but simultaneously may serve as an input terminal, whereby the ergonomics of the press brake can be further increased.

Fastening the capacitive sensor on the cover plate by means of a materially bonded connection furthermore entails the surprising advantage that in case of breakage and/or bursting of the cover plate, the resulting splinters cannot fall out, whereby machine safety can be further increased.

Furthermore, it may be provided that the graphic display is accommodated in a display module, wherein the display module has a frame, in which the graphic display is accommodated, wherein a module rear wall is attached to the frame, wherein a covering screen is formed, to which the cover plate is attached, in particular adhered, wherein the covering screen is coupled to the frame, wherein the covering screen has a screen opening with an opening width and an opening height, wherein the opening width of the screen opening is greater than the display width and/or the opening height of the screen opening is greater than the display height, and wherein the opening width of the screen opening is less than the cover plate width and/or the opening height of the screen opening is less than the cover plate height. Particularly an installation of such a display module entails the advantage that the graphic display can be accommodated securely and durably in the press beam. Thereby, a good reliability of the press brake can be achieved.

An embodiment according to which it may be provided that the frame comprises individual frame elements formed as sheet metal bending parts, wherein fastening supports, in particular threaded pins, are formed for accommodating the frame elements, is also advantageous. Due to this measure, a simple design of the frame can be realized, whereby it may have a low susceptibility to errors. Particularly when using individual frame elements, a high degree of adaptability and/or flexibility of the frame can be achieved. In particular, individual bores formed in the frame can be flexibly adapted to the covering screen by using individual frame elements.

According to an advancement, it is possible that the recess has a tiered design, wherein a first recess tier is formed for accommodating the covering screen, and a second recess tier is formed for accommodating the frame, and wherein a third recess tier passes through the press beam, in particular that a graphic display cable is fed through to the rear side of the press beam in the third recess tier. This entails the advantage that the graphic display can be accommodated well in the press beam. Moreover, a simple cable routing of the graphic display cable can be achieved thereby.

Furthermore, it may be useful if a first sealing element is formed between the covering screen and the first recess tier, and a second sealing element is formed between the module rear wall and the second recess tier. Particularly due to this measure, a good sealing of the graphic display against the environment can be achieved. Hence, the durability of the graphic display can be increased.

Moreover, it may be provided that the graphic display cable passes through the module rear wall and reaches directly into the third recess tier. This entails the advantage that the graphic display cable may have a simple cable routing, which allows preventing damage to the graphic display cable during operation, for example by sheet metal workpieces.

Moreover, it may be provided that the recess has a rounding at least on one of the corners with a rounding radius of between 0.1 mm and 150 mm, in particular between 1 mm and 30 mm, preferably between 5 mm and 15 mm. This entails the surprising advantage that an increased quality of the bending workpieces can be achieved by a press brake of such design. In particular, these measures allow achieving an increased torsional stiffness of the press beam.

Moreover, it is also conceivable that different rounding radii are formed at different recess tiers.

According to a particular embodiment, it is possible that the cover plate is mounted on the frame by means of a double-sided adhesive tape. Particularly a cover plate mounted on the frame like this can be held in a distortion-free and thus stress-free manner during the lifespan of the press brake, whereby a sudden bursting of the cover plate can be prevented and thus, the machine safety can be increased further.

According to an advantageous advancement, it may be provided that two or more recesses are formed in the press beam with one graphic display being accommodated in each of them. This entails advantageous particularly in the case of large press brakes as an accessibility of the graphic display from different positions can be achieved. Furthermore, these measures allow presenting different information in the individual different graphic displays and/or using the different graphic displays for inputting different control commands. The two graphic displays can thus complement one another. Moreover or alternatively, it may be provided that each of the two graphic displays conveys the same information, wherein each of the two graphic displays serves the facilitated accessibility for the machine operator.

In particular, it may be advantageous if a control device is formed, on which at least one graphic display is arranged, wherein the graphic display of the control device is synced with the graphic display accommodated in the press beam. This entails the advantage that the same information and/or the same input options are offered both on the graphic display and on the control device. Thus, for operating the press brake, the machine operator can switch between the control device and the press brake.

Furthermore, it may be provided that the display module is inserted into the press beam from the front side and that fastening means, in particular screws, are arranged on the rear side of the press beam, by means of which fastening means the display module is fastened in the press beam. This entails the advantage that the graphic display has an improved protection against loss, as the fastening means are inserted into the press beam from the rear side. Additionally, this measure allows achieving that the graphic display and/or the display module has clean and tidy optics on the front side of the press beam and furthermore has no projecting parts by which a machine operator could be injured.

The front side within the meaning of this document is the operator side of the press brake. The rear side within the meaning of this document is the side of the press brake facing away from the operator side.

BRIEF DESCRIPTION OF THE DRAWINGS

For the purpose of better understanding of the invention, it will be elucidated in more detail by means of the figures below.

These show in a respectively very simplified schematic representation:

FIG. 5 a sectional view of a first exemplary embodiment of the display according to section line V-V of FIG. 4;

DETAILED DESCRIPTION OF THE PREFERRED EMBODIMENTS

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

Figure 1:
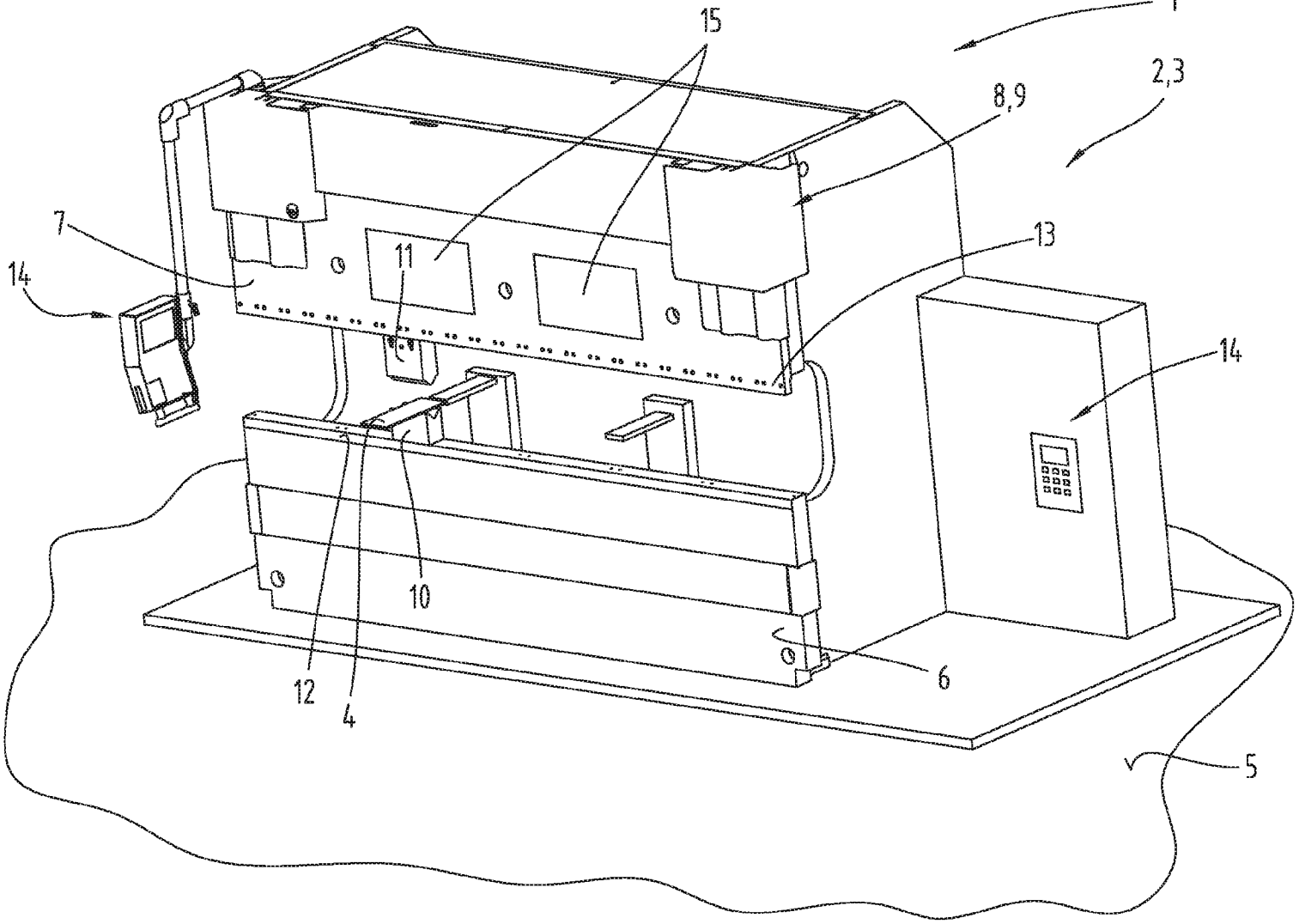
FIG. 1 a perspective representation of an exemplary embodiment of a press brake.

FIG. 1 shows an exemplary embodiment of a workpiece processing machine 1 in the form of a bending machine 2, in particular a press brake 3. The press brake 3 is provided for processing, in particular for bending, a workpiece 4. The press brake 3 has a fixed table beam 6 oriented perpendicularly to a standing surface 5. For processing workpieces 4, the shown press brake 3 comprises a press beam 7, which is adjustable and/or displaceable relative to the table beam 6 in the vertical direction by means of driving means 8, for example hydraulic cylinders 9.

In the press brake 3 according to the exemplary embodiment shown in FIG. 1, the processing and/or forming of a workpiece 4 is effected by means of a lower bending tool 10 and an upper bending tool 11. In this process, the lower bending tool 10, for example a so-called bending die, may be arranged in a lower tool holder 12 of the table beam 6. An upper bending tool 11 and/or a so-called bending punch may be arranged in an upper tool holder 13 of the press beam 7.

Usually, the bending tools 10, 11 are arranged and/or held in the tool holders 12, 13 so as to be replaceable, so that for a respective processing and/or forming of the workpiece 4, correspondingly suitable bending tools 10, 11 can be selected and/or used. Of course, it is also possible that in each case, multiple lower bending tools 10 and upper bending tools 11 are arranged in the tool holders during operation of the press brake 3, for example in order to be able to carry out different bending operations on a workpiece 4 in successive forming and/or bending operations. For the sake of clarity, the exemplary embodiment according to FIG. 1 shows only one lower bending tool 10 and one upper bending tool 11.

For controlling the displacing and/or adjusting movements of the press brake 3, a control device 14 may be provided. As adumbrated in FIG. 1, the control device 14 may comprise multiple components, for example processors and/or computer components, input means for inputting control commands, output means for displaying information, etc. Moreover, it is also possible that the control device 14 is connected to further control components, for example with mobile input and output means, via a network or via the internet.

As can further be seen in FIG. 1, it is provided that one or multiple graphic displays 15 for displaying information are arranged on the displaceable press beam 7 of the press brake 3. In this regard, the graphic display 15 is arranged on the displaceable press beam 7 such that it is displaceable together with the displacement of the press beam 7 in the vertical direction. In particular, it may be provided that the graphic display 15 is coupled to the control device 14.

Figure 2:
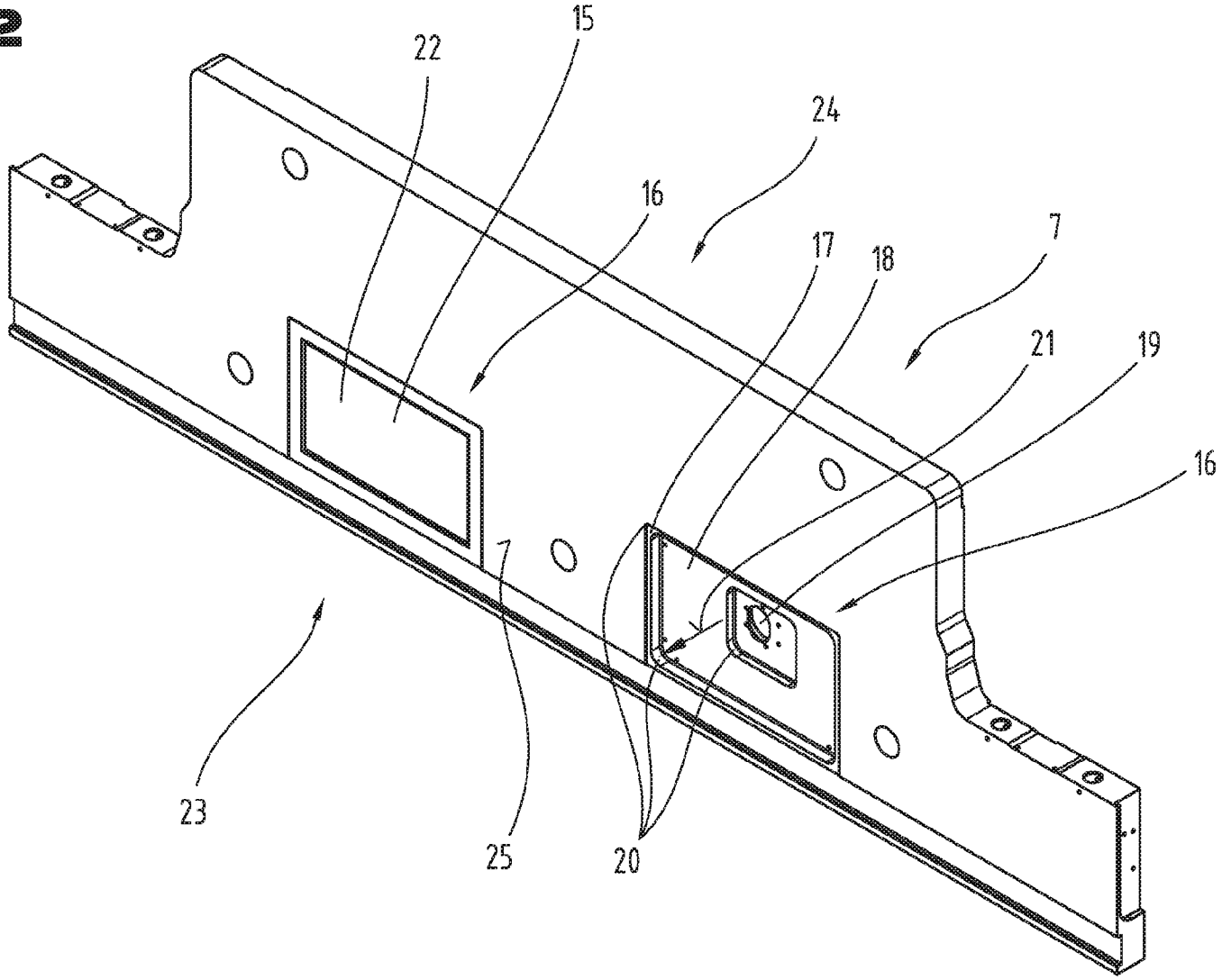
FIG. 2 a perspective representation of an exemplary embodiment of a press beam of a press brake.

FIG. 2 shows a perspective view of a first exemplary embodiment of the press beam 7 of the press brake 3, wherein again, equal reference numbers and/or component designations are used for equal parts as before in FIG. 1. In order to avoid unnecessary repetitions, it is pointed to/reference is made to the detailed description in FIG. 1 preceding it.

As can be seen from FIG. 2, it may be provided for that two graphic displays 15 serving to display information are arranged in the press beam 7.

In the representation according to FIG. 2, only one of the two graphic displays, namely the graphic display 15 on the left of the image, is inserted and the right graphic display 15 is not shown for the sake of clarity. This makes a recess 16 in the press beam 7 visible, which serves to accommodate the graphic display 15.

As can further be seen in FIG. 2, it may be provided that the recess 16 has a tiered design and has a first recess tier 17, a second recess tier 18, and a third recess tier 19. Moreover, it is of course also conceivable that particularly the second recess tier 18 has further tiers. The individual recess tiers 17, 18, 19 serve to accommodate different components of the graphic display 15.

As can further be seen in FIG. 2, it may be provided that the recess 16, in particular one of the recess tiers 17, 18, 19 has a rounding 20 having a rounding radius 21 on one corner.

Moreover, it may be provided that a cover plate 22, which serves to protect the graphic display 15, is formed in front of graphic display 15. The side of the press beam 7 facing the viewer of FIG. 2, in which side the graphic displays 15 are arranged, is referred to as the front side 23. The side of the press beam 7 facing away from the viewer of FIG. 2 is referred to as the rear side 24. As can be seen in FIG. 2, it may be provided that the front side 23 of the cover plate 22 forms an indentation relative to a surface 25 of the press beam 7. In other words, the cover plate 22 is accommodated inside the recess 16 and thus does not project relative to the surface 25 of the press beam 7.

Figure 3:
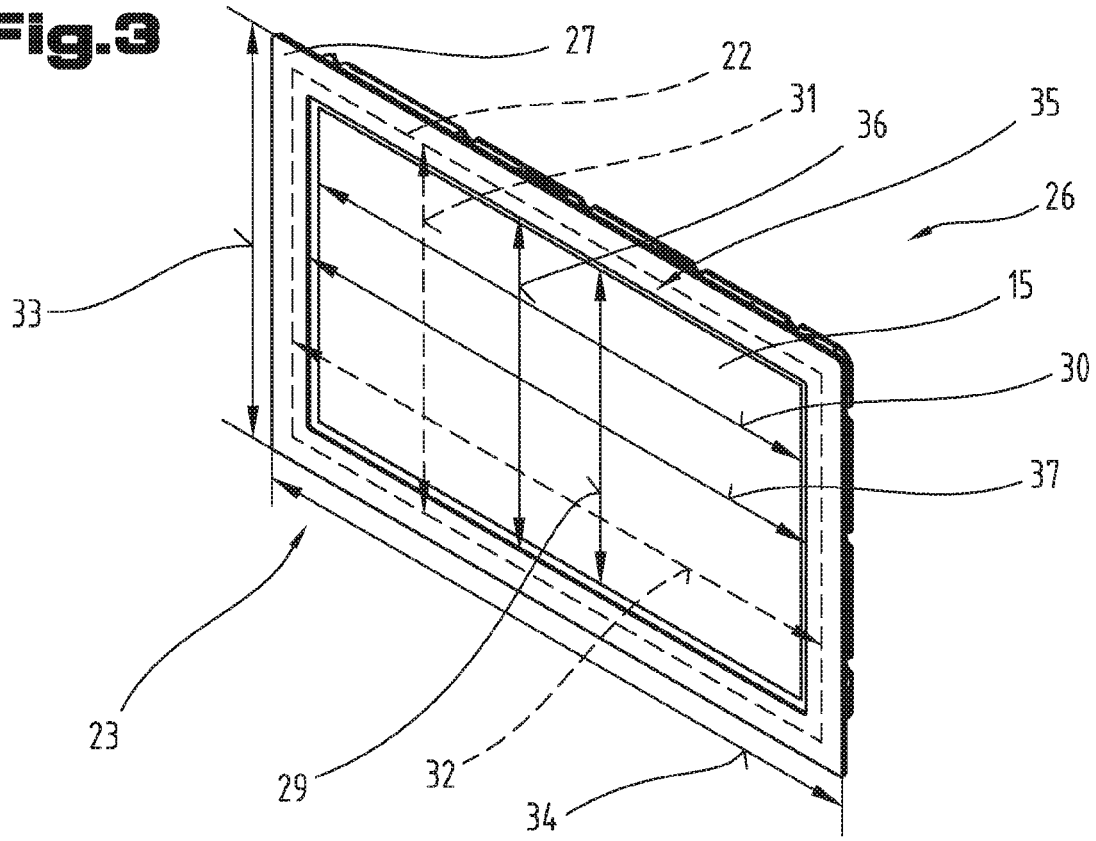
FIG. 3 a perspective representation of a first exemplary embodiment of a display module in a front view.

FIG. 3 shows a first exemplary embodiment of a display module 26 in which the graphic display 15 is arranged. In the perspective view according to FIG. 3, the display module 26 is shown with a view of the front side 23.

Figure 4:
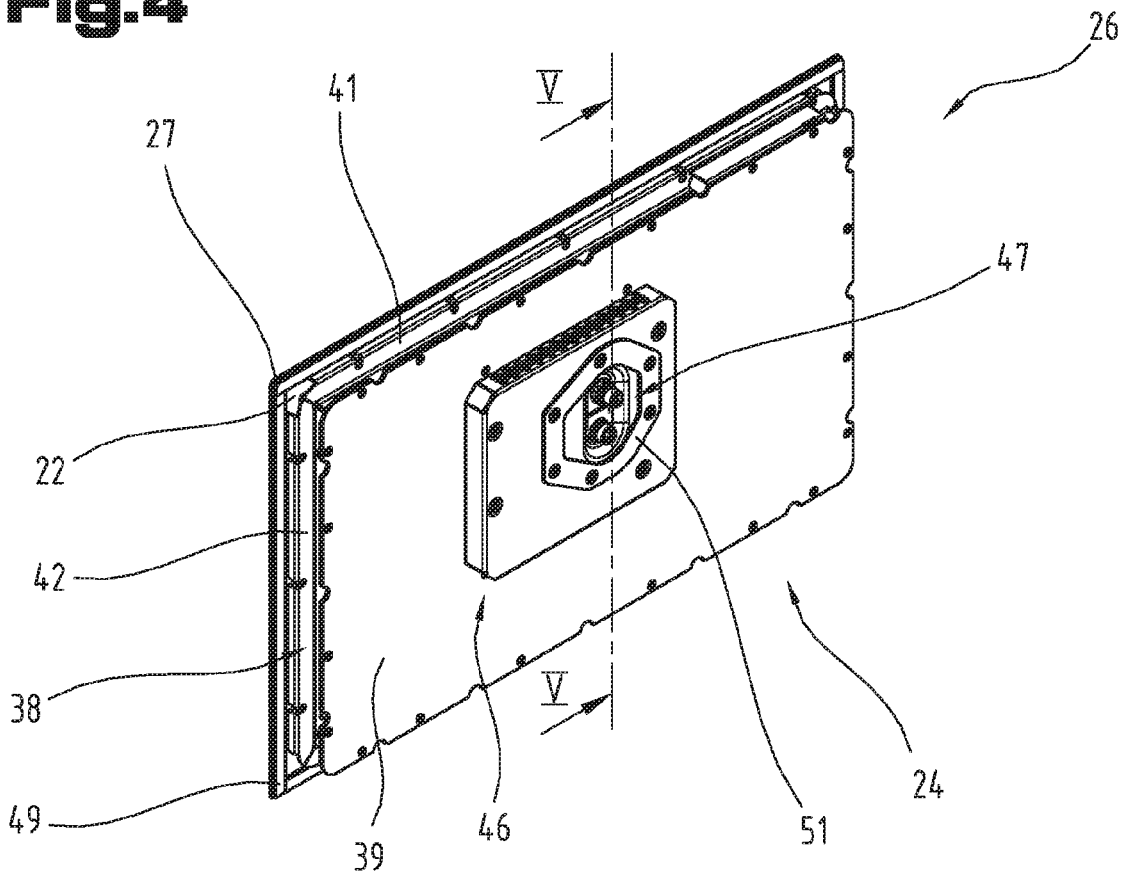
FIG. 4 a perspective representation of a first exemplary embodiment of the display module in a rear view.

FIG. 4 shows he display module 26 with a view from the rear side 24.

In FIG. 5, the display module 26 is shown in a sectional view according to line V-V from FIG. 4.

FIGS. 3 to 5 show further views of the display module 26, wherein again, equal reference numbers and/or component designations are used for equal parts as in the respectively preceding figures. In order to avoid unnecessary repetitions, it is pointed to/reference is made to the detailed description in the respectively preceding figures.

The individual components of the display module 26 is described with the aid of a combination of FIGS. 3 to 5.

As can be seen from FIGS. 3 to 5, it may be provided that the display module 26 comprises a covering screen 27, on which the cover plate 22 may be accommodated. On the rear side of the cover plate 22, a touch sensor 28 may be arranged, which may serve for inputting commands. The touch sensor 28 may be attached directly on the cover plate 22 by means of a materially bonded connection, in particular be attached to the rear side 24 of the cover plate 22.

Moreover, it is conceivable that the cover plate 22 is attached to the covering screen 27 by means of a materially bonded connection, in particular an adhesive connection. The cover plate 22 may be formed of a shatterproof and transparent material, such as a glass. Moreover, it may be provided that the cover plate 22 is attached to the frame 38 by means of a double-sided adhesive tape 53.

As can be seen from FIG. 3, the graphic display 15 has a display height 29 and a display width 30. The cover plate 22 has a cover plate height 31 and a cover plate width 32. The covering screen 27 has a screen height 33 and a screen width 34. Moreover, a screen opening 35 is formed in the covering screen 27, which screen opening 35 has an opening height 36 and an opening width 37.

The cover plate 22 and/or the graphic display 15 underneath it is visible through the screen opening 35 of the covering screen 27. For this purpose, it is necessary that the cover plate 22 is formed of a transparent material. The covering screen 27 may be formed of a metallic material. In particular, it may be provided that the covering screen 27 is formed from a sheet metal part.

As can be seen particularly well from a combination of FIGS. 3 and 5, it may be provided that the cover plate height 31 is less than the screen height 33. Moreover, the cover plate width 32 may be less than the screen width 34. This may help achieve that the covering screen 27 protrudes laterally relative to the cover plate 22. This protrusion may serve the clean accommodation of the display module 26 in the recess 16.

Moreover, it may be provided that the opening height 36 is less than the cover plate height 31, and the opening width 37 is less than the cover plate width 32. Due to this measure, the cover plate 22 may abut the covering screen 27 and thus be attached to the covering screen 27 in a materially bonded manner. In particular it may be provided that the dimension ratios of the opening height 36 and/or opening width 37 and the cover plate height 31 and/or cover plate width 32 are selected such that the screen opening 35 is covered by the cover plate 22 on all sides by between 1 mm and 30 mm, in particular between 5 mm and 25 mm, preferably between 10 mm and 15 mm.

Moreover, it may be provided that the opening height 36 is greater than the display height 29, and the opening width 37 is greater than the display width 30. This entails the advantage that the machine operator can utilize the full display dimensions in case a touch display is present. If the opening height 36 were to be of the same size or less than the display height 29 and/or the opening width 37 of the same size or less than the display width 30, the edge region of the display could no longer be used, as the machine operator would not be able to carry out touch inputs here.

As can be seen from a combination of FIGS. 4 and 5, it may be provided that the display module 26 comprises a frame 38, which laterally houses the graphic display 15. The frame 38 may directly adjoin the covering screen 27 on its front side and be closed by the covering screen 22. On the rear side of the frame 38, a module rear wall 39 may be formed, which also closes the frame 38. The graphic display 15 can thus be accommodated in a receiving space 40, which is bounded on the front side by the cover plate 22, on its side by the frame 38, and on the rear side by the module rear wall 39. By means of this design, the graphic display 15 can be protected from environmental influences and/or be safely accommodated in said receiving space 40.

Moreover, it may be provided that the frame 38 comprises four frame elements 41 which form the rectangular frame. The individual frame elements 41 may be formed, for example, as a formed sheet metal part. Moreover, it may be provided that fastening supports 42 are arranged on the covering screen 27, which fastening supports 42 serve to fasten the frame elements 41 and/or the frame 38 to the covering screen 27. The fastening supports 42 may be designed in the form of threaded pins, which may be attached to the covering screen 27. Moreover, it may be provided that the fastening supports 42, in particular the threaded pins, are coated with a protective coat in order to avoid damage to the cover plate 22. In this regard, the protective coat may be formed of a material that is soft compared to the fastening supports 42, such as a plastic material or rubber.

Moreover, it may be provided that recesses are formed in the frame 38 and/or in the individual frame elements 41, through which recesses the fastening supports 42 may protrude, and wherein the frame 38 and/or the frame elements 41 may be attached to the covering screen 27 by means of fastening elements 43, such as nuts, which cooperate with the fastening support 42. Moreover, it may be provided that the individual frame elements 41 have an L-shaped clamping limb 44, by means of which the cover plate 22 can be pressed against the covering screen 27 and thus be clamped. This may serve the additional attachment of the cover plate 22 on the covering screen 27.

The module rear wall 39 may also be attached to the frame 38 or the frame elements 41 by means of fastening means 45.

Moreover, it may be provided that an attachment housing 46 is formed, which is arranged on the module rear wall 39 and serves to accommodate electronic components. Furthermore, a plug 47 may be arranged in the attachment housing 46, which plug 47 serves the connection of a graphic display 48. For the sake of simplicity, the attachment housing 46 may also be viewed as a part of the module rear wall 39.

Figure 6:
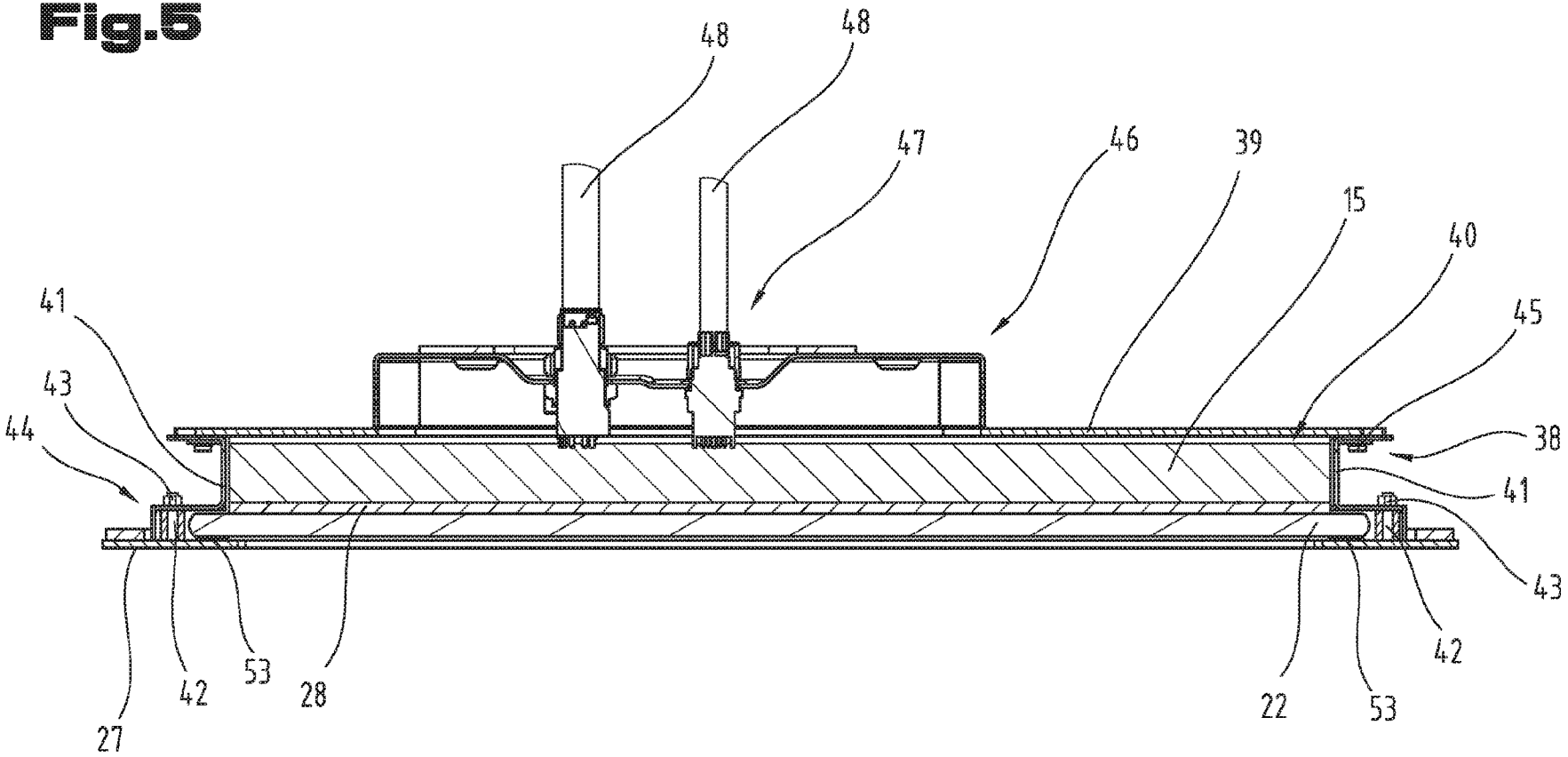
FIG. 6 a sectional view of a first exemplary embodiment of the display according to section line V-V of FIG. 4, wherein the display module is shown inserted into the press beam.
Figure 6:
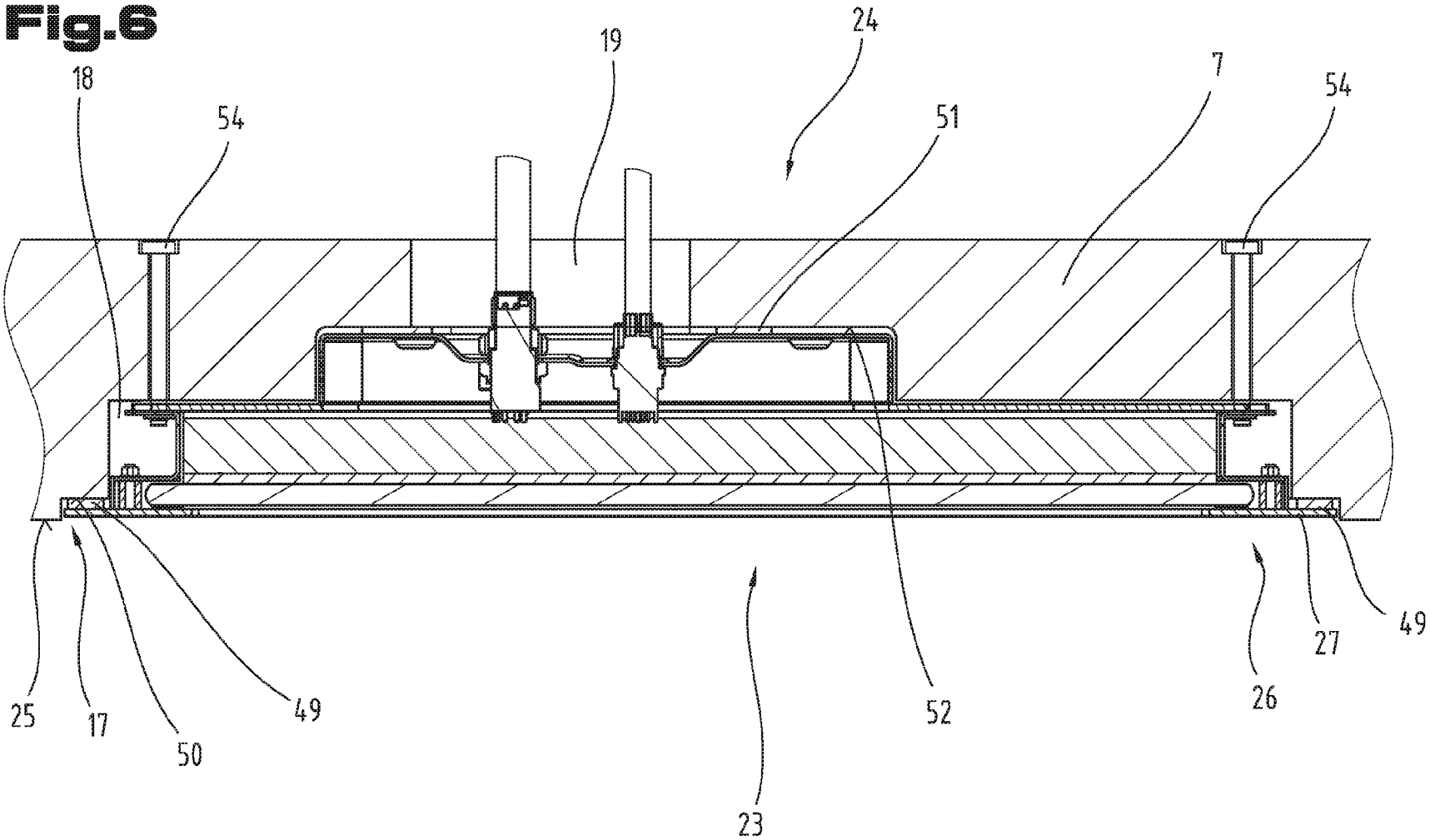

FIG. 6 shows the display module 26 in a sectional representation of the view in FIG. 5, wherein, however, in FIG. 6 the display module 26 is shown in its state accommodated in the press beam 7. In this regard, equal reference numbers and/or component designations are again used for equal parts as in FIGS. 1 to 5. In order to avoid unnecessary repetitions, it is pointed to/reference is made to the detailed description in FIGS. 1 through 5.

As can be seen in FIG. 6, it may be provided that a first sealing element 49 is arranged between the covering screen 27 and a first recess base 50 of the first recess tier 17. Moreover, it may be provided that a second sealing element 51 is arranged between the attachment housing 46 and/or the module rear wall 39 and a second recess base 52 of the second recess tier 18. The sealing elements 49, 51 may have a circumferential design, so that the display module 26 can be accommodated in the recess 16 so as to be protected against environmental influences.

As can further be seen from FIG. 6, it may be provided that the display module 26 can be fixed in the press beam 7 by means of fastening means 54. In this regard, the fastening means 54 can be inserted into the press beam 7 from its rear side 24.

Moreover, it may be provided that the two sealing elements 49, 51 are flexible and have a certain thickness, so that a sufficient sealing can be achieved in both sealing planes when pressing the display module 26 against the press beam 7.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the technical teaching provided by the present invention lies within the ability of the person skilled in the art in this technical field.

The scope of protection is determined by the claims. Nevertheless, the description and drawings are to be used for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

| List of reference numbers | |
|---|---|
| 1 | Workpiece processing machine |
| 2 | Bending machine |
| 3 | Press brake |
| 4 | Workpiece |
| 5 | Standing surface |
| 6 | Table beam |
| 7 | Press beam |
| 8 | Driving means |
| 9 | Hydraulic cylinder |
| 10 | Lower bending tool |
| 11 | Upper bending tool |
| 12 | Lower tool holder |
| 13 | Upper tool holder |
| 14 | Control device |
| 15 | Graphic display |
| 16 | Recess |
| 17 | First recess tier |
| 18 | Second recess tier |
| 19 | Third recess tier |
| 20 | Rounding |
| 21 | Rounding radius |
| 22 | Cover plate |
| 23 | Front side |
| 24 | Rear side |
| 25 | Surface |
| 26 | Display module |
| 27 | Covering screen |
| 28 | Touch sensor |
| 29 | Display height |
| 30 | Display width |
| 31 | Cover plate height |
| 32 | Cover plate width |
| 33 | Screen height |
| 34 | Scree width |
| 35 | Screen opening |
| 36 | Opening height |
| 37 | Opening width |
| 38 | Frame |
| 39 | Module rear wall |
| 40 | Receiving space |
| 41 | Frame element |
| 42 | Fastening support |
| 43 | Fastening element |
| 44 | Clamping limb |
| 45 | Fastening means |
| 46 | Attachment housing |
| 47 | Plug |
| 48 | Graphic display cable |
| 49 | First sealing element |
| 50 | First recess base |

-continued

| List of reference numbers | |
|---|---|
| 51 | Second sealing element |
| 52 | Second recess base |
| 53 | Double-sided adhesive tape |
| 54 | Fastening means |

The invention claimed is:

1. A press brake for bending workpieces, the press brake comprising:

a fixed table beam having a lower tool holder, a displaceable press beam having an upper tool holder, wherein the press beam is provided so as to be displaceable relative to the table beam, a graphic display for displaying information, wherein a recess is provided in the displaceable press beam, wherein the graphic display is accommodated in the recess, wherein the graphic display has a display height and a display width, wherein a cover plate having a cover plate height and a cover plate width is provided, which is arranged in front of the graphic display so as to cover the graphic display, wherein the graphic display is accommodated in a display module, wherein the display module has a frame, in which the graphic display is held, wherein a module rear wall is attached to the frame, wherein a covering screen is provided, to which the cover plate is fastened, wherein the covering screen is coupled to the frame, wherein the covering screen has a screen opening having an opening width and an opening height, wherein the opening width of the screen opening is greater than the display width and/or the opening height of the screen opening is greater than the display height, wherein the opening width of the screen opening is less than the cover plate width and/or the opening height of the screen opening is less than the cover plate height, wherein the frame comprises individual frame elements formed as sheet metal bending parts, and wherein fastening supports are formed on the covering screen for accommodating the frame elements.

2. The press brake according to claim 1, wherein the cover plate is accommodated in the recess such that a front side of the cover plate forms an indentation relative to a surface of the press beam.

3. The press brake according to claim 2, wherein a touch sensor is arranged on a rear side of the cover plate, wherein the touch sensor is mounted directly on the cover plate by a materially bonded connection.

4. The press brake according to claim 1, wherein the recess has a rounding at least on one edge of the recess, wherein the rounding has a rounding radius of between 0.1 mm and 150 mm.

5. The press brake according to claim 1, wherein a further recess is provided in the press beam, and wherein one graphic display is accommodated in each of them the recess and the further recess.

6. The press brake according to claim 1, wherein a control device is provided, on which at least one graphic display is arranged, wherein the graphic display of the control device is synced with the graphic display accommodated in the press beam.

7. The press brake according to claim 2, wherein the cover plate is adhered to the covering screen.

8. The press brake according to claim 7, wherein the fastening supports comprise threaded pins.

9. The press brake according to claim 7, wherein the cover plate is fastened to the frame by a double-sided adhesive tape.

10. The press brake according to claim 7, wherein the fastening supports comprise screws.

11. The press brake according to claim 7, wherein the recess has a tiered design, wherein a first recess tier is provided for accommodating the covering screen, and a second recess tier is provided for accommodating the frame, and wherein a third recess tier extends through the press beam and a graphic display cable is fed through to a rear side of the press beam in the third recess tier.

12. The press brake according to claim 11, wherein a first sealing element is provided between the covering screen and the first recess tier, and a second sealing element is provided between the module rear wall and the second recess tier.

13. The press brake according to claim 11, wherein the graphic display cable passes through the module rear wall and reaches directly into the third recess tier.

14. A press brake for bending workpieces, the press brake comprising:

a fixed table beam having a lower tool holder, a displaceable press beam having an upper tool holder, wherein the press beam is provided so as to be displaceable relative to the table beam, a graphic display for displaying information, wherein a recess is provided in the displaceable press beam, wherein the graphic display is accommodated in the recess, wherein the graphic display has a display height and a display width, wherein a cover plate having a cover plate height and a cover plate width is provided, which is arranged in front of the graphic display so as to cover the graphic display, wherein the graphic display is accommodated in a display module, wherein the display module has a frame, in which the graphic display is held, wherein a module rear wall is attached to the frame, wherein a covering screen is provided, to which the cover plate is fastened, wherein the covering screen is coupled to the frame, wherein the covering screen has a screen opening having an opening width and an opening height, wherein the opening width of the screen opening is greater than the display width and/or the opening height of the screen opening is greater than the display height, wherein the opening width of the screen opening is less than the cover plate width and/or the opening height of the screen opening is less than the cover plate height, wherein the recess has a tiered design, wherein a first recess tier is provided for accommodating the covering screen, and a second recess tier is provided for accommodating the frame, and wherein a third recess tier extends through the press beam.

15. A press brake for bending workpieces, the press brake comprising:

a fixed table beam having a lower tool holder, a displaceable press beam having an upper tool holder, wherein the press beam is provided so as to be displaceable relative to the table beam, a graphic display for displaying information, wherein a recess is provided in the displaceable press beam, wherein the graphic display is accommodated in the recess, wherein the graphic display has a display height and a display width, wherein a cover plate having a cover plate height and a cover plate width is provided, which is arranged in front of the graphic display so as to cover the graphic display, wherein the graphic display is accommodated in a display module, wherein the display module has a frame, in which the graphic display is held, wherein a module rear wall is attached to the frame, wherein a covering screen is provided, to which the cover plate is fastened, wherein the covering screen is coupled to the frame, wherein the covering screen has a screen opening having an opening width and an opening height, wherein the opening width of the screen opening is greater than the display width and/or the opening height of the screen opening is greater than the display height, wherein the opening width of the screen opening is less than the cover plate width and/or the opening height of the screen opening is less than the cover plate height, wherein the display module is inserted into the press beam from a front side, wherein fastening means are arranged on the rear side of a press beam, and wherein the display module is fastened in the press beam using the fastening means.

16. A press brake for bending workpieces, the press brake comprising:

a fixed table beam having a lower tool holder, a displaceable press beam having an upper tool holder, wherein the press beam is provided so as to be displaceable relative to the table beam, a graphic display for displaying information, wherein a recess is provided in the displaceable press beam, wherein the graphic display is accommodated in the recess, wherein the graphic display has a display height and a display width, wherein a cover plate having a cover plate height and a cover plate width is provided, which is arranged in front of the graphic display so as to cover the graphic display, wherein the graphic display is accommodated in a display module, wherein the display module has a frame, in which the graphic display is held, wherein a module rear wall is attached to the frame, wherein a covering screen is provided, to which the cover plate is fastened, wherein the covering screen is coupled to the frame, wherein the covering screen has a screen opening having an opening width and an opening height, wherein the opening width of the screen opening is greater than the display width and/or the opening height of the screen opening is greater than the display height, wherein the opening width of the screen opening is less than the cover plate width and/or the opening height of the screen opening is less than the cover plate height, and wherein the cover plate is arranged between the covering screen and the graphic display.

* * * * *